US008809661B2

(12) United States Patent
Seno et al.

(10) Patent No.: US 8,809,661 B2
(45) Date of Patent: Aug. 19, 2014

(54) TUNING DEVICE

(71) Applicant: Roland Corporation, Shizuoka (JP)

(72) Inventors: Tatsuya Seno, Shizuoka (JP); Shohei Okumura, Shizuoka (JP); Hirofumi Yui, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 13/960,825

(22) Filed: Aug. 7, 2013

(65) Prior Publication Data

US 2014/0041509 A1 Feb. 13, 2014

(30) Foreign Application Priority Data

Aug. 9, 2012 (JP) ..... 2012-177501

(51) Int. Cl.
*G10D 7/02* (2006.01)
*G10G 7/02* (2006.01)

(52) U.S. Cl.
CPC ..... *G10G 7/02* (2013.01)
USPC ..... 84/453

(58) Field of Classification Search
USPC ..... 84/453, 312 R, 454
See application file for complete search history.

(56) References Cited

U.S. PATENT DOCUMENTS 5,427,011 A 6/1995 Steinberger
5,877,443 A * 3/1999 Arends et al. ..... 84/454
8,334,449 B2 * 12/2012 Nielsen et al. ..... 84/454

FOREIGN PATENT DOCUMENTS

JP H07-253776 10/1995
JP 2681432 11/1997

* cited by examiner

*Primary Examiner* — Kimberly Lockett
(74) *Attorney, Agent, or Firm* — Jianq Chyun IP Office

(57) ABSTRACT

A tuning device that facilitates the checking of the pitch of each sound is provided. The tuning device includes a pitch name display means including display positions that are arranged in a pitch order respectively corresponding to pitch names constituting an octave. A reference display position is lighted solely when the pitch of an input sound is in an in-tune state, namely, a difference between the reference pitch and the pitch of the input sound is in a range of ±α (α>0). When the pitch of the input sound is outside a predetermined range, the reference display position and an adjacent display position are both lighted in a way that the reference display position gradually becomes darker while the adjacent display position gradually becomes brighter as an absolute value of the difference (deviation degree of the input pitch relative to the reference pitch) increases.

9 Claims, 7 Drawing Sheets

| reference pitch name | range of the difference Δ of the pitch of the input sound relative to the reference pitch | luminance L (%) of each indicator of the pitch name display | | | | | | |
|---|---|---|---|---|---|---|---|---|
| | | … | B | C | C # | D | D # | … |
| ⋮ | ⋮ | … | ⋮ | ⋮ | ⋮ | ⋮ | ⋮ | … |
| C | -50cent ≦ Δ < -10cent | … | 80 ≧ L > 0 | 80 ≦ L < 100 | 0 | 0 | 0 | … |
| | -10cent ≦ Δ ≦ +10cent | | 0 | 100 | 0 | 0 | 0 | |
| | +10cent < Δ < +50cent | | 0 | 100 > L > 80 | 0 < L < 80 | 0 | 0 | |
| C # | -50cent ≦ Δ < -10cent | … | 0 | 80 ≧ L > 0 | 80 ≦ L < 100 | 0 | 0 | … |
| | -10cent ≦ Δ ≦ +10cent | | 0 | 0 | 100 | 0 | 0 | |
| | +10cent < Δ < +50cent | | 0 | 0 | 100 > L > 80 | 0 < L < 80 | 0 | |
| D | -50cent ≦ Δ < -10cent | … | 0 | 0 | 80 ≧ L > 0 | 80 ≦ L < 100 | 0 | … |
| | -10cent ≦ Δ ≦ +10cent | | 0 | 0 | 0 | 100 | 0 | |
| | +10cent < Δ < +50cent | | 0 | 0 | 0 | 100 > L > 80 | 0 < L < 80 | |
| ⋮ | ⋮ | … | ⋮ | ⋮ | ⋮ | ⋮ | ⋮ | … |

FIG. 2

| range of the difference Δ of the pitch of the input sound relative to the reference pitch | first indicator (indicator of " # ") | second indicator (indicator of " b ") |
|---|---|---|
| +40cent < Δ ≦ +50cent | light-off | light-off |
| +5cent < Δ ≦ +40cent | light-on | light-off |
| −5cent ≦ Δ ≦ +5cent | light-on | light-on |
| −40cent ≦ Δ < −5cent | light-off | light-on |
| −50cent ≦ Δ < −40cent | light-off | light-off |

FIG. 4

TUNING DEVICE

CROSS-REFERENCE TO RELATED APPLICATIONS

This application claims the priority benefit of Japan application serial no. 2012-177501, filed on Aug. 9, 2012. The entirety of the above-mentioned patent application is hereby incorporated by reference herein and made a part of this specification.

BACKGROUND OF THE INVENTION

1. Field of the Invention

The invention relates to a tuning device and particularly relates to a tuning device that facilitates checking a pitch of each sound.

2. Description of Related Art

A conventional tuning device (e.g. Patent Literature 1) is known to have a pitch name display, which displays a pitch name, and an auxiliary display, which displays pitch deviation of a sound to be tuned (i.e. input sound), as an object of the tuning, relative to the pitch name displayed by the pitch name display.

FIG. 7A is a schematic diagram illustrating a form of a chromatic tuner display 100, as disclosed in Patent Literature 1. The chromatic tuner display 100, depicted in FIG. 7A, includes a pitch name display 120 and an auxiliary display 121 located on an upper side of the pitch name display 120, wherein the pitch name display 120 has twelve indicators 120*a*-120*l* (Note: l is displayed in cursive in the figure) that are linearly arranged corresponding to twelve pitch names, apart by an octave, respectively. Further, FIG. 7B is a schematic diagram illustrating another form of the chromatic tuner display 100 disclosed in Patent Literature 1. The chromatic tuner display 100 of FIG. 7B also includes a pitch name display 120 and an auxiliary display 121, but the twelve indicators 120*a*-120*l* of the pitch name display 120 are circularly arranged and the auxiliary display 121 is located on an inner side of the pitch name display 120.

The chromatic tuner display 100 of FIGS. 7A-7B lights one of the indicators 120*a*-120*l* which corresponds to the pitch name (i.e. reference pitch name) that is the target for matching pitches (i.e. for performing tuning) and lights the auxiliary display 121 according to a relative difference between the pitch of the sound to be tuned and the pitch (i.e. reference pitch) of the reference pitch name. More specifically, a central display position 121*a* of the auxiliary display 121 is lighted when it is determined that the pitch of the sound to be tuned is within a tolerance range of pitch deviation based on the reference pitch and matched thereto (tuning is completed, or called an in-tune state). The auxiliary display 121 includes several display positions arranged along a right direction (i.e. arrow-A direction) from the display position 121*a* and several display positions arranged along a left direction (i.e. arrow-B direction). In the case that the pitch of the sound to be tuned deviates higher than the reference pitch, the display positions on the right side of the display position 121*a* are lighted in turn, starting from the display position adjacent to the display position 121*a* to the display position 121*b*, as the degree of deviation increases. If the display position 121*b* is lighted, it indicates that the deviation of the pitch of the sound to be tuned relative to the reference pitch is +50 cent. Likewise, in the case that the pitch of the sound to be tuned is lower than the reference pitch, the display positions on the left side of the display position 121*a* are lighted in turn, starting from the display position adjacent to the display position 121*a* to the display position 121*c*, as the degree of deviation increases. If the display position 121*c* is lighted, it indicates that the deviation of the pitch of the sound to be tuned relative to the reference pitch is −50 cent. Accordingly, the auxiliary display 121 can display the deviation of the pitch of the sound to be tuned relative to the reference pitch discretely in a range of ±50 cent. In addition to the above, a needle-type display has also been used as an auxiliary display, which includes a needle that swings right and left continuously in the range from −50 cent (left end) to +50 cent (right end) to indicate the deviation of the pitch of the sound to be tuned relative to the reference pitch of the reference pitch name.

According to the conventional tuning device, the pitch name displayed by the pitch name display is switched to one new pitch name whose reference pitch is closest to the pitch of the sound to be tuned. And, at the same time, the performer reads the auxiliary display (i.e. pitch deviation display) to learn the degree of deviation of the pitch of the sound to be tuned (e.g. voice of the performer or sound output by the performer, etc.) relative to the reference pitch of the new pitch name. For example, in the case of using a needle-type pitch deviation display as the auxiliary display, the pitch of the sound to be tuned is higher than the reference pitch when the needle swings to the right, and the pitch of the sound to be tuned is lower than the reference pitch when the needle swings to the left. Moreover, if the needle swings to a large extent, it indicates that the degree of pitch deviation of the sound to be tuned relative to the reference pitch is large. The performer may look at the needle of the auxiliary display while practicing to control the production method of the sound at each pitch, in order to maintain the needle in the center, that is, to sing or play the instrument on the right pitch. For instance, in the case that the needle swings to the right, the performer may lower the pitch of his/her voice or the sound he/she plays in order to maintain the needle at the central position. If the needle swings to the left, the performer may, on the contrary, raise the voice/sound to maintain the needle at the central position.

PRIOR ART LITERATURE

Patent Literature

[Patent Literature 1] Japanese Patent Publication No. 7-253776

SUMMARY OF THE INVENTION

Problem to be Solved

However, the conventional tuning device has the problem that the display presented by the auxiliary display is disordered during the practice of accurate pitch. For instance, the needle of the needle-type auxiliary display swings to the left or the right to a large extent when the pitch of the sound to be tuned approximates to the middle of two reference pitches that respectively correspond to two adjacent pitch names, namely, the pitch of the sound to be tuned deviates close to a ½ semitone (−50 cent or +50 cent) relative to the reference pitch. The reason is that, the reference pitches pointed by the needle serves as the reference for measuring the pitch deviation, when the pitch of the sound to be tuned swings around the middle of the two adjacent different reference pitches, the needle is switched frequently responsive to the swing, and the deviation of the pitch of the sound to be tuned relative to the reference pitch right before the switching is temporarily reset whenever the swing occurs. Thus, for example, a plus error relative to the reference pitch of a certain reference pitch name is suddenly changed to a minus when the reference pitch is switched a half step up, and consequently the needle swings greatly from the plus side (right side) to the minus side (left side) before and after the switching of the reference pitch. On the other hand, a minus error relative to a certain reference pitch is suddenly changed to a plus when the reference pitch is switched a half step down, and consequently the needle swings greatly from the minus side to the plus side before and after the switching of the reference pitch. As described above, the auxiliary display of the conventional tuning device presents disordered display before and after the switching of the reference pitch which serves as the reference for measuring the pitch deviation, and therefore, various problems occur when the pitch of the sound to be tuned varies continuously.

For scale practice and glissando practice, etc., performed vocally or with a wind instrument such as a flute, when several sounds of different pitches are continuously played, the methods for vocalizing, fingering, and shaping the lips (embouchure) may differ from each other according to the pitches of the sounds produced. For this reason, right after a sound of a new pitch is produced, it is difficult to stabilize the pitch, and the sound may not reach the pitch or is too high at the start. In particular, when a vocal beginner or wind instrument beginner sings/plays an unfamiliar scale or sings/plays at a difficult high pitch during scale practice, the pitch of the sound to be tuned may easily deviate close to ±50 cent relative to the target reference pitch name. However, as mentioned above, the display presented by the auxiliary display of the conventional tuning device is disordered before and after the switching of the reference pitch, which serves as the reference for measuring pitch deviation. Thus, it is difficult for the performer to check the reference pitch name, i.e. the target of tuning, and the degree of pitch deviation of the input sound relative to the reference pitch of the reference pitch name. The conventional tuning device is not suitable for scale practice and glissando practice, etc., that are performed vocally or with a wind instrument, such as a flute.

Moreover, when practicing singing (trill) by continuously raising and lowering the pitches over a large pitch difference (for example, the two pitches, C and D, are 2 degrees apart(2 semitones)), the conventional auxiliary display, such as the needle-type auxiliary display, whose needle swings greatly to the left and the right whenever the sung pitch crosses a point of switching the reference pitch, as the reference for measuring the pitch deviation(the point refers to the middle pitch between C and C♯, and the middle pitch between C♯ and D). Therefore, it is difficult to check the swing state of the sung pitch during vibrato with the auxiliary display of the conventional tuning device.

Besides, in the case of vocal performance, the conventional needle-type auxiliary display reflects every small pitch swing with the swing of the needle. In order to have a favorable musical effect in teems of vocal characteristic, the pitch of the sound swings in an suitable range. For this reason, the needle swings too sensitively even to a pitch fluctuation that is in the suitable range, which may give the user unnecessarily strict pitch determination results. Thus, the conventional needle-type auxiliary display is unsuitable for vocal pitch practice.

The needle-type auxiliary display is exemplified above to explain the problems that occur in the conventional auxiliary display. It can be easily understood that the same problems are also found in the conventional auxiliary display 121 shown in FIGS. 7A and 7B.

In view of the above, the invention provides a tuning device that facilitates checking the pitch of each sound, particularly for a vocal performer and a wind instrument performer, etc.

Solution to the Problem and Effect of the Invention

Considering the above, a tuning device according to the present invention includes a pitch name display means provided with display positions that are arranged in a pitch order respectively corresponding to the pitch names constituting an octave. Based on the pitch of an input sound detected by a pitch detection means, a pitch name determining means determines one pitch name (i.e. reference pitch name) of the pitch names constituting the octave in the pitch name display means, which has a reference pitch closest to the pitch of the input sound. And, when a difference between the reference pitch corresponding to the determined reference pitch name and the pitch of the input sound is in a range of $\pm\alpha$ ($\alpha>0$), a reference display position, which is the display position corresponding to the reference pitch name, is lighted by a first lighting control means. At the same time, the display position adjacent to the reference display position is not lighted. Thus, in the case that the display positions that constitute the pitch name display means are arranged by unit of a semitone, for example, the reference display position is solely lighted while the display position that is half step-up or half step-down to the reference pitch name is in a light-off state. When the user sees such a state, he/she can know that the pitch of the input sound (the sound to be tuned) matches the reference pitch of the reference pitch name, which is the target of tuning (namely, the in-tune state).

Furthermore, in the case that the difference is outside the range of $\pm\alpha$ ($\alpha>0$), the reference display position and an adjacent display position, which corresponds to the pitch name that is adjacent to the reference pitch name and close to the pitch of the input sound, are both lighted by the first lighting control means in a way that the reference display position gradually becomes darker while the adjacent display position gradually becomes brighter as an absolute value of the difference increases. In other words, when the difference of the pitch of the input sound relative to the reference pitch of the reference pitch name increases to a certain degree, the reference display position and the adjacent display position are both lighted. Therefore, for example, in the case that the display positions of the pitch name display means are arranged by unit of a semitone, the reference display position and the adjacent display position corresponding to the reference pitch of the half step-up pitch name are both lighted when the difference of the pitch of the input sound relative to the reference pitch increases to a certain degree on the high pitch side. On the other hand, the reference display position and the adjacent display position corresponding to the reference pitch of the half step-down pitch name are both lighted when the difference of the pitch of the input sound relative to the reference pitch increases to a certain degree on the low pitch side. And, as the absolute value of the difference between the reference pitch and the pitch of the input sound increases (that is, as the pitch of the input sound deviates away from the reference pitch), the reference display position gradually becomes darker while the adjacent display position gradually becomes brighter. On the contrary, as the absolute value of the difference decreases (that is, as the pitch of the input sound gets closer to the reference pitch), the reference display position gradually becomes brighter while the adjacent display position gradually becomes darker. Accordingly, the degree that the pitch of the input sound deviates from the reference pitch and the deviation direction thereof (to the high pitch side or the low pitch side) can be determined based on the brightness degree of two adjacent display positions (luminance or brightness/shade of lighting). Thus, in comparison with the tuning process that requires visually recognizing two displays separately (pitch name display and auxiliary display), the checking of the reference pitch name, which serves as the target of tuning, and the deviation degree of the pitch of the input sound relative to the reference pitch of the reference pitch name in the invention can be easily carried out by looking at one display (i.e. pitch name display means).

In addition, according to the tuning device, the deviation degree of the pitch is presented by a continuous variation of brightness of each display position of the pitch name display means, which is convenient and ergonomically-friendly or sensuously-friendly particularly for vocal performers. Furthermore, unlike the conventional needle-type auxiliary display, the tuning device does not give unnecessarily strict pitch determination results.

Moreover, in the case that the pitch of the input sound varies continuously in a direction toward the high pitch side or the low pitch side, the reference pitch name determined by the pitch name determining means is switched when a certain pitch is reached. When the switching occurs, the display position that has been the adjacent display position so far becomes the reference display position, and the display position that has been the reference display position so far becomes the adjacent display position. If the pitch of the input sound varies further, the pitch of the input sound gradually approximates to the reference pitch of the reference pitch name after the switching (i.e. the current reference pitch name), and consequently, the absolute value of the difference between the two pitches gradually decreases. Accordingly, the display position (i.e. the current reference display position) that has been the adjacent display position so far gradually becomes brighter and the display position (i.e. the current adjacent display position) that has been the reference display position so far gradually becomes darker. In this way, if the pitch of the input sound varies continuously in one direction, the display positions of the pitch name display means continuously become brighter and darker in sequence responsive to the pitch of the input sound, and simultaneously, the display positions are sequentially lighted in accordance with the variation direction of the pitch. Therefore, even when doing glissando practice vocally or with a wind instrument, the display, which varies with the continuously-changing pitch of the input sound, is continuous and smooth, rather than disordered. In this aspect, the checking of the reference pitch name, which serves as the target of tuning, and the deviation degree of the pitch of the input sound relative to the reference pitch of the reference pitch name can be easily carried out to facilitate the tuning process. Moreover, because the display, which varies with the continuously-changing pitch of the input sound, is continuous and smooth rather than disordered, when practicing vibrato of a large pitch difference (e.g. 2 semitones), for example, the user can also easily check the swing condition of the pitch. Hence, the vocal tuning process for singing practice can be performed easily.

In addition to the effects performed by the above tuning device, the tuning device further has the following effects. The display positions are circularly arranged in a pitch order in a way that the pitch name at one end and the pitch name at the other end of the octave with twelve display devices adjoin each other. Thus, in the case that the pitch of the input sound varies continuously in one direction, the display positions are continuously lighted only in a clockwise direction or in an anti-clockwise direction, regardless of which display position is first lighted corresponding to the pitch of the input sound. Accordingly, the display positions are not lighted unnaturally, e.g. randomly, in a direction reverse to the variation direction of the pitch, and the checking of the pitch of each sound can be easily performed.

Particularly, for a tuning device, like the chromatic tuner display 100 of FIG. 7A, in which twelve indicators 120*a*-120*l* are linearly arranged, when the pitch name determined based on the pitch of the input sound varies from B to the half step-up C, the lighted display position moves over a long distance from B on the right side to C on the left side. For a variation of the display pitch name to the half step-up pitch, the lighted position is switched to the indicator adjacent on the right side, which is natural sensuously. The large movement from the indicator on the right side to the indicator on the left side in the direction reverse to the variation direction of the pitch gives the user a feeling of discord. The tuning device of the present invention can eliminate such discord.

In addition to the effects performed by the above tuning device, the tuning device further has the following effects. The reference display position is lighted at the maximum luminance if the difference between the reference pitch and the pitch of the input sound is in a first range of $\pm\alpha$ ($\alpha>0$). That is, the reference display position is solely lighted at the maximum luminance, and two adjacent display positions adjacent to the reference display position are not lighted. Therefore, the user can easily learn that the pitch of the input sound matches the reference pitch.

In addition to the effects performed by the above tuning device, the tuning device further has the following effects. If the difference between the reference pitch and the pitch of the input sound is in a predetermined second range set within the first range of $\pm\alpha$ ($\alpha>0$), the difference being in the second range is notified visually or audibly by a notification control means. Accordingly, the user can easily learn that the pitch of the input sound (sound to be tuned) closely matches the reference pitch. Moreover, it should be understood that "a predetermined second range set within the first range" includes a case where the second range is narrower than the first range and a case where the second range is equal to the first range.

In addition to the effects performed by the above tuning device, the tuning device further has the following effects. An auxiliary display means is provided, which includes a first display position indicating that the pitch of the input sound deviates to the high pitch side relative to the reference pitch, and a second display position indicating that the pitch of the input sound deviates to the low pitch side relative to the reference pitch. In this auxiliary display means, the lighting of the first display position and the second display position is controlled by a second lighting control means responsive to the difference between the reference pitch and the pitch of the input sound. Accordingly, the auxiliary display means further suggests the deviation direction of the pitch of the input sound relative to the reference pitch for the user to easily understand the deviation direction of the pitch.

In addition to the effects performed by the above tuning device, the tuning device further has the following effects. The first display position and the second display position are not lighted when the difference between the reference pitch of the reference pitch name and the pitch of the input sound is outside a range of $\pm\beta$ ($\beta>0$) and in a range of {(the reference pitch of the pitch name adjacent to the reference pitch name−the reference pitch of the reference pitch name)/2} (this value$\neq\pm\beta$). That is to say, in the case that the pitch of the input sound is in a predetermined range apart from the middle pitch of the reference pitches of adjacent pitch names, the first display position and the second display position are not lighted. Because the reference pitch name determined by the pitch name determining means is switched at a boundary, namely, the middle pitch between the pitches of adjacent pitch names, if the pitch of the input sound falls in the predetermined range including the boundary, neither the first display position nor the second display position is lighted, so as to prevent disordered display that occurs when the reference pitch name is switched.

In addition to the effects performed by the above tuning device, the tuning device further has the following effects. When the difference between the reference pitch and the pitch of the input sound is in the range of $\pm\beta$ ($\beta>\alpha$) over a predetermined time, a lighting control is performed by a second lighting control means to control the first display position and/or the second display position according to the above mentioned pitch difference. Accordingly, the first display position or the second display position is not lighted instantly when the pitch of the input sound falls in the range, so as to prevent flickering of the auxiliary display means (first display position, second display position).

In addition to the effects performed by the above tuning device, the tuning device further has the following effects. The reference display position and the adjacent display position are lighted at equal luminance when the difference between the reference pitch of the reference pitch name and the pitch of the input sound is {(the reference pitch of the pitch name adjacent to the reference pitch name−the reference pitch of the reference pitch name)/2}. Therefore, the possibility of misidentifying to which of two adjacent pitch names the pitch of the input sound approximates is reduced.

In addition to the effects performed by the above tuning device, the tuning device further has the following effects. During tuning, the pitch for matching from now on is taken as the reference pitch, and a target display position, which is the display position corresponding to the pitch name of the sound (i.e. target sound) that is the target of tuning, is controlled by a third lighting control means and lighted in a lighting form different from a lighting form in which the reference display position or the adjacent display position is lighted by the first lighting control means. Therefore, the lighting of the target display position and the lighting of the reference display position or the adjacent display position can be distinguished from each other. Accordingly, the user can easily perform tuning for matching his/her pitch to the target sound.

BRIEF DESCRIPTION OF THE DRAWINGS

FIG. 2 is a table illustrating the relationship between the difference of the pitch of an input sound relative to the reference pitch and the luminance of each indicator of the pitch name display.

FIG. 4 is a table illustrating the difference of the pitch of the input sound relative to the reference pitch and lighting states of first and second indicators.

DESCRIPTION OF THE EMBODIMENTS

Figure 1B:
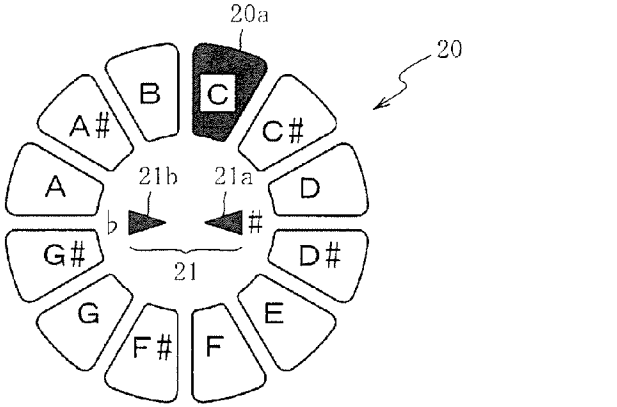
FIG. 1B to FIG. 1D are schematic diagrams illustrating the display performed by a pitch name display and an auxiliary display.

Preferable exemplary embodiments of the invention are described in the following paragraphs with reference to the affixed figures. FIG. 1A is a schematic front view of a tuning device 1. The tuning device 1 is configured for tuning a vocal sound and an instrument sound, etc., and includes a pitch name display 20, an auxiliary display 21, a microphone 22, and an operation panel 15. The tuning device 1 detects the pitch of a sound input via the microphone 22 and lights the pitch name display 20 and the auxiliary display 21 based on the detected pitch. Details thereof are provided hereinafter.

The pitch name display 20 is configured for displaying a pitch name responsive to the pitch of the input sound (i.e. a sound that is to be tuned). The pitch name display 20 includes twelve indicators 20*a*-20*l* respectively corresponding to twelve pitch names (C, C♯, D, D♯, E, F, F♯, G, G♯, A, A♯, B) that constitute an octave. In the figures, the lowercase letter "l" is all in cursive. The indicators 20*a*-20*l* are circumferentially arranged in a pitch order such that one end pitch name (e.g. C) and the other end pitch name (e.g. B) of the octave adjoin each other. Each of the indicators 20*a*-20*l* includes a translucent cover with a pitch name marked thereon and an LED (light emitting diode) covered by the cover. And, the indicators 20*a*-20*l* are lighted by the LEDs.

The auxiliary display 21 is configured for displaying a deviation direction of the pitch of the input sound relative to a reference pitch of a reference pitch name determined according to the pitch of the input sound. The auxiliary display 21 is arranged on an inner side of the circumferentially arranged indicators 20*a*-20*l* and includes a first indicator 21*a* and a second indicator 21*b*. The first indicator 21*a* is configured for indicating that the pitch of the input sound deviates to a high side (♯side) relative to the reference pitch. The second indicator 21*b* is configured for indicating that the pitch of the input sound deviates to a low side (♭ side) relative to the reference pitch. Each of the first and second indicators 21*a* and 21*b* includes a translucent cover and an LED covered by the cover. And, the first and second indicators 21*a* and 21*b* are lighted by the LEDs.

Figure 1D:
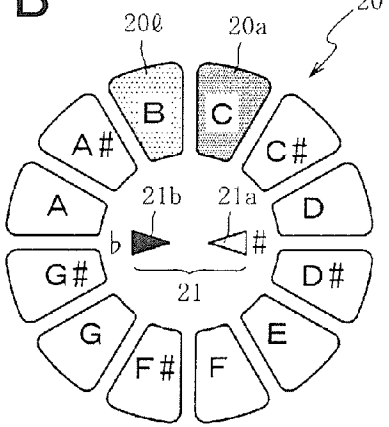
Figure 1C:
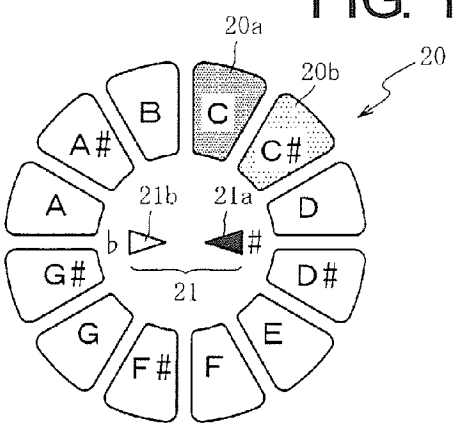
Figure 1A:
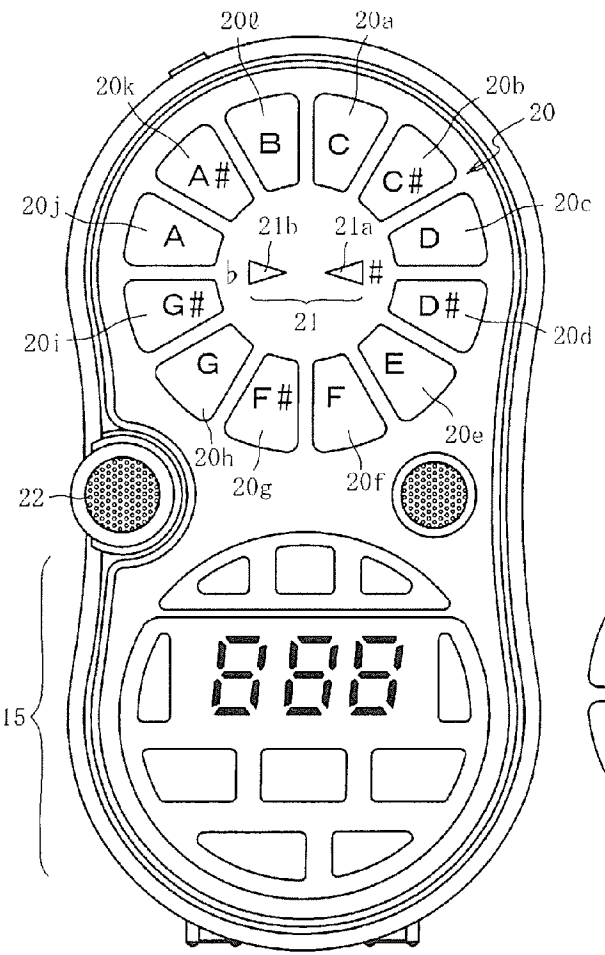
FIG. 1A is a schematic front view of a tuning device.

FIG. 1B to FIG. 1D are schematic diagrams illustrating the display performed by the pitch name display 20 and the auxiliary display 21. FIG. 1B to FIG. 1D exemplify that the pitch name (i.e. the reference pitch) determined responsive to the pitch of the input sound is "C."

According to the tuning device 1 of this embodiment, when the reference pitch (i.e. reference pitch "C") of the reference pitch name "C" and the pitch of the input sound are in an in-tune state, namely, the deviation of the pitch of the input sound relative to the reference pitch "C" is within a pitch deviation tolerance range (i.e. the pitches match musically), the indicator 20*a* which corresponds to the reference pitch name "C" is lighted to the maximum luminance (100%), and the light of the adjacent indicators 20*b* and 20*l* are off, as shown in FIG. 1B. Then, by confirming that the indicator 20*a* is lighted at the maximum luminance and that the adjacent indicators 20*b* and 20*l* corresponding to pitch names C♯ and B are in a light-off state, the match of the pitch of the input sound and the reference pitch "C", namely successful tuning, can be visually determined. In the example shown in FIG. 1B to FIG. 1D, the lighted indicators among the indicators 20*a*-20*l* are hatched, and the difference in luminance is represented by different hatching (light or shade). To be more specific, darker hatching represents higher luminance while lighter hatching represents lower luminance. In FIG. 1B, the indicator 20*a* lighted at the maximum luminance is hatched the darkest.

In addition, if the difference between the reference pitch and the pitch of the input sound increases to a certain degree, one of the indicators 20*b* and 20*l* adjacent to the indicator 20*a* is lighted simultaneously with the indicator 20*a*, as illustrated in FIG. 1C and FIG. 1D. More specifically, in the case that the pitch of the input sound deviates to the high side relative to the reference pitch "C," the indicator 20*a* corresponding to the pitch name "C" and the indicator 20*b* corresponding to the pitch name "C♯" are lighted. Moreover, in the case that the pitch of the input sound deviates to the low side relative to the reference pitch "C," the indicator 20*a* and the indicator 20*l* corresponding to the pitch name "B" are lighted. To be more detailed, once the difference between the reference pitch "C" and the pitch of the input sound exceeds a predetermined threshold value, the luminance of the indicator 20*a* gradually decreases and the luminance of the adjacent indicator 20*b* or 20*l* gradually increases as an absolute value of the difference increases, namely, the pitch of the input sound deviates from the reference pitch "C" toward the reference pitch "C♯" or "B" of the adjacent pitch name.

For example, in the case that the pitch of the input sound continuously varies from the reference pitch "C" toward "C♯," when the difference between the reference pitch "C" and the pitch of the input sound exceeds the predetermined threshold value (e.g. +10 cent), the luminance of the indicator 20*a* gradually decreases while the luminance of the indicator 20*b* gradually increases, as shown in FIG. 1C. If the pitch of the input sound deviates further to the high pitch side, soon the luminance of the indicator 20*a* will drop to 0% and the luminance of the indicator 20*b* will become 100%, and the pitch of the input sound will reach the reference pitch "C♯." The reference pitch name is the one whose reference pitch is closest to the pitch of the input sound. Therefore, in the case that the pitch of the input sound gradually varies from the reference pitch "C" to "C♯," the reference pitch name is switched from "C" to "C♯" when the pitch of the input sound crosses a boundary, i.e. a middle pitch between the reference pitch "C" and the reference pitch "C♯." Through such a series of operations, the user can visually learn the deviation of the pitch of the input sound from the reference pitch "C" toward the high pitch side and finally to the reference pitch "C♯," based on the luminances of the adjacent indicators 20*a* and 20*b*.

Furthermore, in the case that the pitch of the input sound continuously varies from the reference pitch "C" toward "B," when the difference between the reference pitch "C" and the pitch of the input sound exceeds the predetermined threshold value (e.g. −10 cent), the luminance of the indicator 20*a* gradually decreases while the luminance of the indicator 20*l* gradually increases, as shown in FIG. 1D. If the pitch of the input sound deviates further toward the reference pitch "B," soon the luminance of the indicator 20*a* will drop to 0% and the luminance of the indicator 20*l* will become 100%, and the pitch of the input sound will reach the reference pitch "B." In the case that the pitch of the input sound gradually varies from the reference pitch "C" to "B," the reference pitch name is switched from "C" to "B" when the pitch of the input sound crosses a boundary, i.e. a middle pitch between the reference pitch "C" and the reference pitch "B." Through such a series of operations, the user can visually learn the deviation of the pitch of the input sound from the reference pitch "C" toward the low pitch side and finally to the reference pitch "B," based on the luminances of the adjacent indicators 20*a* and 20*l*.

Moreover, when the tuning device 1 of this embodiment is used, in the case that the pitch of the input sound continuously varies toward the high pitch side, the indicators 20*a*-20*l* of the pitch name display 20 are sequentially switched to the indicator that corresponds to the new reference pitch name in a clockwise order as the reference pitch names are switched. What is more, during the switching of the reference pitch names, among the adjacent indicators, the luminance of the indicator corresponding to the pitch name on the low pitch side, i.e. the previous reference pitch name, gradually decreases while the luminance of the indicator corresponding to the adjacent pitch name on the high pitch side gradually increases before the switching. Thus, at the time of switching from one reference pitch name to another, the lighting of two adjacent indicators is not interrupted, discontinued, or disordered, and the lighting of the indicators is smoothly switched in the clockwise order from the indicator corresponding to one pitch name to the indicator corresponding to the new reference pitch name that is adjacent on the high pitch side. Likewise, in the case that the pitch of the input sound continuously varies toward the low pitch side, the display is not disordered at the time of switching from one reference pitch name to another, and the lighting of the indicators is smoothly switched in an anti-clockwise order from the indicator corresponding to one pitch name to the indicator corresponding to the new reference pitch name that is adjacent on the low pitch side.

Accordingly, the tuning device 1 facilitates the checking of the pitch of each sound for vocal scale practice and wind instrument scale practice, etc. In particular, the tuning device 1 is preferred for visually checking pitch variation during portamento (a style of performance that involves continuously raising or lowering pitches with predetermined pitch difference), for example. In addition, the indicators are circumferentially arranged in the pitch order such that one end pitch name (e.g. "C") and the other end pitch name (e.g. "B"), among the 12 pitches of the octave, adjoin each other. The pitch name corresponds to the reference pitch to which the input sound is closest to is lighted. No matter from which display position the lighting begins and no matter the pitch gradually deviates higher or lower, the indicators are always lighted continuously in sequence in the clockwise direction or the anti-clockwise direction. In this respect, the checking of the pitch of each sound is easily carried out.

Besides, the auxiliary display 20 assists to indicate the deviation degree of the pitch of the input sound relative to the reference pitch. For instance, the tuning device 1 lights both of the first indicator 21*a* and the second indicator 21*b* when the difference of the pitch of the input sound relative to the reference pitch is smaller than a predetermined value. Here, the predetermined value is a tolerance range of the pitch deviation relative to the reference pitch, in which the pitch of the input sound is determined as matching the reference pitch, for notifying the user that the simultaneous lighting of the first indicator 21*a* and the second indicator 21*b* indicates the state that the pitch of the input sound matches the reference pitch (successful tuning, or in-tune).

Furthermore, when two adjacent indicators of the pitch name display 20 are lighted at the same time, namely, the difference between the reference pitch and the pitch of the input sound increases to a certain degree (i.e. not in the in-tune state), only one of the first indicator 21*a* and the second indicator 21*b* is lighted based on whether the pitch deviation of the input sound is toward the high pitch side or the low pitch side of the reference pitch. As illustrated in FIG. 1C, for example, when the pitch of the input sound deviates toward the high pitch side relative to the reference pitch of the reference pitch name, the first indicator 21*a* (indicator of "♯") is lighted. On the other hand, as illustrated in FIG. 1D, when the pitch of the input sound deviates toward the low pitch side relative to the reference pitch of the reference pitch name, the second indicator 21*b* (indicator of "♭") is lighted. One of the first indicator 21*a* and the second indicator 21*b* is lighted responsive to a deviation direction of the pitch of the input sound relative to the reference pitch of the reference pitch name. Thus, this auxiliary information, in addition to the information of the deviation direction of the pitch of the input sound provided by the pitch name display 20, makes it easy for the user to learn the deviation direction of the pitch.

Figure 3:
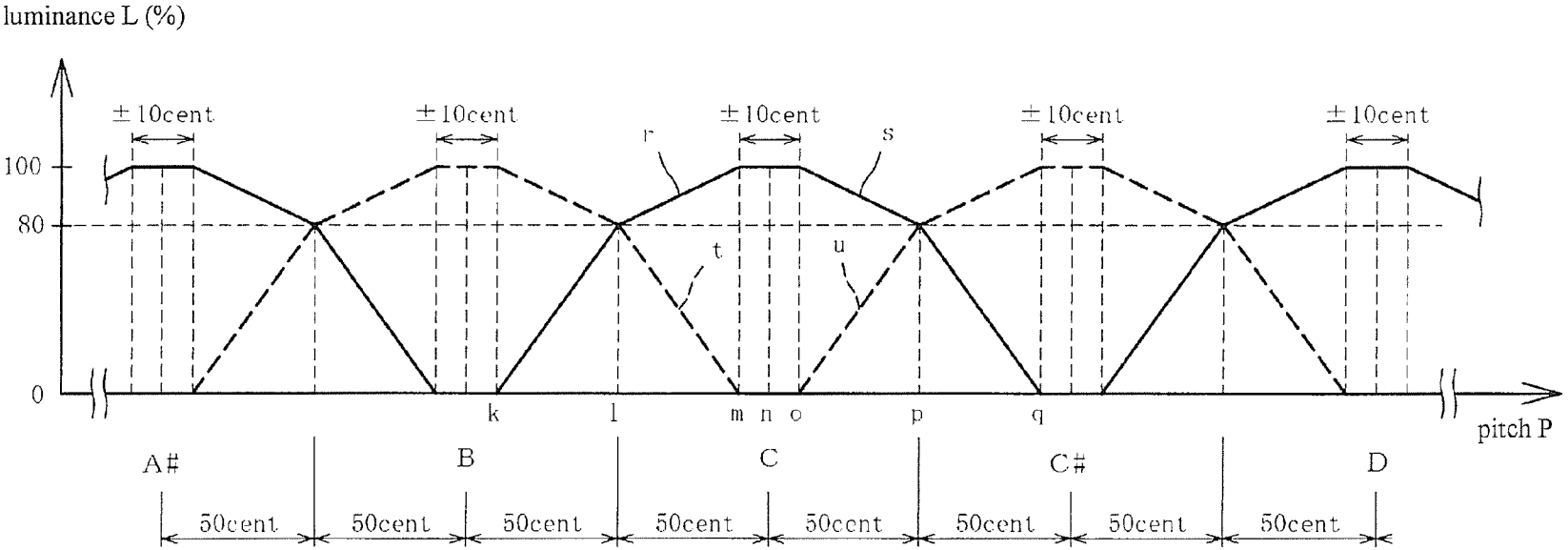
FIG. 3 is a graph illustrating the luminance variation of each indicator with respect to the pitch of the input sound.

FIG. 2 is a table illustrating the relationship between the difference of the pitch of the input sound relative to the reference pitch and the luminance of each indicator 20*a*-20*l* of the pitch name display 20. FIG. 3 is a graph illustrating the luminance variation of each indicator 20*a*-20*l* with respect to the pitch of the input sound. With reference to the graph of FIG. 3, the horizontal axis represents a pitch P and the vertical axis represents a luminance L (%). As mentioned above, only one indicator which corresponds to the reference pitch is lighted, or two indicators (i.e. the indicator corresponding to the reference pitch and one indicator adjacent thereto) are lighted simultaneously according to the difference (i.e. a value obtained by subtracting the reference pitch from the pitch of the input sound) between the pitch of the input sound and the reference pitch. With reference to one pitch name, e.g. "C", as shown in FIG. 2, when the difference Δ between the pitch of the input sound and the reference pitch of the reference pitch name determined according to the pitch of the input sound falls in the range of −10 cent≤Δ≤+10 cent, the indicator corresponding to the reference pitch name is lighted at the luminance L of 100%. In the case that the reference pitch name is "C," for example, the indicator 20*a* corresponding to the reference pitch name "C" is lighted at the luminance L of 100% in sections m-o of FIG. 3.

Moreover, in the case of −50 cent≤Δ<−10 cent, namely, the difference Δ drops under −10 cent relative to the reference pitch of the reference pitch name, the luminance of the indicator corresponding to the reference pitch name gradually decreases in a range of 0≤L<100 as the absolute value of the difference Δ increases (that is, as the pitch of the input sound decreases). Meanwhile, the luminance of the indicator adjacent to the reference pitch name on the low pitch side increases in a range of 80≥L>0 as the absolute value of the difference Δ increases. For instance, in the case of the reference pitch name "C," in sections l-m of FIG. 3, the pitch of the input sound gradually decreases, and the luminance of the indicator 20*a* corresponding to the reference pitch name "C" decreases and the luminance of the indicator 20*l* corresponding to the pitch name "B" increases as the absolute value of the difference Δ increases.

Besides, in the case of +10 cent<Δ<+50 cent, namely, the pitch of the input sound is raised over +10 cent relative to the reference pitch of the reference pitch name, the luminance of the indicator corresponding to the reference pitch name decreases in a range of 100>L>80 as the absolute value of the difference Δ increases (that is, as the pitch of the input sound increases). Meanwhile, the luminance of the indicator adjacent to the reference pitch name on the high pitch side increases in a range of 0<L<80 as the absolute value of the difference Δ increases. For example, in the case of the reference pitch name "C," in sections o-p of FIG. 3, the pitch of the input sound gradually increases, and the luminance of the indicator 20*a* corresponding to the reference pitch name "C" decreases and the luminance of the indicator 20*b* corresponding to the pitch name "C♯" increases as the absolute value of the difference Δ increases.

As illustrated in FIG. 3, the lines representing the luminances of the indicators corresponding to two adjacent pitch names intersect each other in the middle between the pitches corresponding to the adjacent pitch names. In this embodiment, the luminance of each indicator at the intersection point is 80%. A pitch difference between adjacent pitch names is 100 cent. Therefore, in the case of the reference pitch name "C," for example, the luminance of the indicator 20*a* and the luminance of the indicator 20*b* or 20*l* are 80% at positions of ±150 cent from the corresponding reference pitch "C."

Referring to one pitch name, e.g. "C," shown in FIG. 3, for example, when the deviation of the pitch of the input sound exceeds ±10 cent from the reference pitch "C," the luminance of the indicator 20*a* gradually decreases from 100% to 80% and the indicator 20*a* becomes darker as the deviation increases in the range of ±50 cent, namely, in sections l-m and o-p. Furthermore, when the deviation of the pitch of the input sound exceeds ±50 cent from the reference pitch "C," namely, in sections k-l and p-q, the luminance of the indicator 20*a* gradually decreases further, as the deviation increases, and then becomes light-off (i.e. luminance=0%). If the pitch of the input sound exceeds the range of ±50 cent from the reference pitch "C," the reference pitch is switched from "C" to "C♯" or "B." When the pitch of the input sound exceeds the range of ±90 cent relative to the reference pitch "C," the indicator 20*a* is light-off, and at the same time, the luminance of the indicator 20*b* or 20*l* corresponding to the reference pitch "C♯" or "B" becomes 100%.

As shown in FIG. 3, in the case that the value of luminance of the indicators in the middle of each of adjacent pitches corresponding to adjacent pitch names is larger than 50%, a luminance decreasing rate of the indicator corresponding to the reference pitch is smaller than a luminance increasing rate of the adjacent indicator corresponding to the adjacent reference pitch. The luminance decreasing rate of the indicator decreases as the pitch of the input sound deviates from the reference pitch, and the luminance increasing rate of the adjacent indicator increases as the pitch of the input sound deviates from the reference pitch. For example, in the case of the reference pitch name "C," a variation rate of the luminance of the indicator 20*a* with respect to the pitch deviation of the input sound from the reference pitch "C," namely, inclinations of lines r and s, is smaller than a variation rate of the luminances of the indicators 20*l* and 20*b* with respect to the pitch deviation of the input sound from the reference pitch "C," namely, inclinations of lines t and u. Accordingly, in such a case, the luminance of the indicator 20*a* gradually decreases from 100%, as the pitch of the input sound deviates from the reference pitch "C," until the reference pitch name is switched, which is slow in comparison with the variation of the luminance of the adjacent indicator. For this reason, the variation of luminance of the indicators corresponding to two adjacent pitch names can be modulated when the reference pitch name is switched.

FIG. 4 is a table illustrating the difference Δ of the pitch of the input sound relative to the reference pitch and lighting states of the first and second indicators 21*a* and 21*b* of the auxiliary display 21. As shown in FIG. 4, the first indicator 21*a* and the second indicator 21*b* are lighted or not lighted responsive to the difference Δ between the pitch of the input sound and the reference pitch. More specifically, in the case of −5 cent≤Δ≤+5 cent, the first indicator 21*a* and the second indicator 21*b* are both lighted (light-on), and it indicates that the pitch of the input sound almost matches the reference pitch. Here, a range of the difference Δ (i.e. second range) where both of the first indicator 21*a* and the second indicator 21*b* are lighted is set to be narrower than a range of the difference Δ (i.e. first range: −10 cent≤Δ≤+10 cent) where only the indicator corresponding to the reference pitch name is lighted. With this setting, by continuing one of the indicators 20*a*-20*l* is solely lighted at the luminance of 100%, the user first learns that the pitch of the input sound is near the reference pitch within a wide range and in an in-tune state (referred to as a "first in-tune state" hereinafter). Then, as the pitch of the input sound gets closer to the reference pitch, both of the first indicator 21*a* and the second indicator 21*b* are lighted simultaneously, and the user learns that the pitch of the input sound approximates to the reference pitch within a narrow range and in an in-tune state (referred to as "second in-tune state" hereinafter).

Moreover, in the case of +5 cent<Δ≤+40 cent, namely, when the pitch of the input sound is high and exceeds +5 cent relative to the reference pitch, only the first indicator 21*a* (i.e. indicator of "♯") is lighted. Meanwhile, in the case of −40 cent≤Δ<−5 cent, namely, when the pitch of the input sound is low and drops under −5 cent relative to the reference pitch, only the second indicator 21*b* (i.e. indicator of "♭") is lighted. Accordingly, the user can know whether the pitch of the input sound is higher or lower than the reference pitch based on the lighting of the first indicator 21*a* and the second indicator 21*b*.

According to the above, by dividing the in-tune state of the pitch of the input sound into two stages, namely, the first and the second in-tune states (i.e. wider and narrower pitch deviation tolerance ranges), the user can easily know whether the pitch of the input sound (i.e. the sound to be tuned) more accurately matches the reference pitch of the reference pitch name. In addition, the function of separately displaying two stages of the in-tune state of the pitch of the input sound is effective in practicing how to perform with stable and accurate pitches from the start of each sound in the case of continuously performing several different high pitch sounds during scale practice of vocal and wind instrument performance.

An example is given below. For example, when doing scale practice with a wind instrument, e.g. flute, through control of raising and lowering a major scale of C major, the performer who may be a beginner, may start with playing the scales of C major in the order of C, D, E, and so on in a slow tempo while looking at the lighting of the indicators 20*a*-20*l* of the pitch name display 20 corresponding to the twelve pitches. For example, the performer may check the lighting states of the corresponding indicator 20*a* (indicator "C"), indicator 20*c* (indicator "D"), indicator 20*e* (indicator "E"), and so on in sequence by the pitches that are sequentially played. In a case when the reference pitch name "C", is a goal of the first stage, the sounds produced immediately after the performer starts blowing each pitch will be in the in-tune state (the first in-tune state) where the adjacent two indicators, such as indicators 20*b* and 20*l* (i.e. indicators of "C♯" and "B") are not lighted and only the indicator 20*a* (i.e. indicator of "C") is lighted at luminance of 100%.

Even when the first in-tune state is shown at all the pitches of the seven notes of the major scale of C major, through simultaneously checking the auxiliary display 21 that further determines the in-tune state with a narrow tolerance range, the performer may find that some pitches among the seven notes of the C major scale slightly deviate to the low side or the high side. That is to say, if the first indicator 21*a* is lighted while the second indicator 21*b* is not lighted at a certain pitch, the performer knows that, even though the pitch is in the first in-tune state, the pitch is still higher than the reference pitch of the reference pitch name (i.e. slightly sharp). On the contrary, if the first indicator 21*a* is not lighted while the second indicator 21*b* is lighted, the performer knows that even though the pitch is in the first in-tune state, the pitch is lower than the reference pitch (i.e. slightly flat). To achieve the goal of the second stage, the performer may pay attention to these specific pitches and adjust the pitches of the sounds he/she produces during scale practice, so as to fulfill both the first in-tune state where the indicator 20*a* (indicator "C"), indicator 20*c* (indicator "D"), indicator 20*e* (indicator "E"), and so forth are all lighted at the luminance of 100%, and the in-tune state (second in-tune state) where both of the auxiliary indicators 21*a* and 21*b* are lighted at every pitch of the scale.

Accordingly, through practice stage by stage, the performer can do scale practice effectively so as to produce each sound at the accurate pitch. Furthermore, the deviation tolerance ranges of the first and second in-tune states relative to the reference pitch may be selected or adjusted by the user according to the performer's proficiency level or his/her purpose of practice. Moreover, the deviation tolerance ranges of the first and second in-tune states relative to the reference pitch can be set to be equalized and the auxiliary display may be used for the user to more easily check the in-tune state.

Additionally, in the case of +40 cent<Δ≤+50 cent or −50 cent≤Δ<−40 cent, the first indicator 21*a* and the second indicator 21*b* are not lighted (light-off). Accordingly, near the middle between the pitches corresponding to the adjacent pitch names, namely, near a pitch at which the reference pitch name is about to be switched, none of the first indicator 21*a* and the second indicator 21*b* is lighted, so as to prevent disordered display when switching the reference pitch name.

Figure 5A:
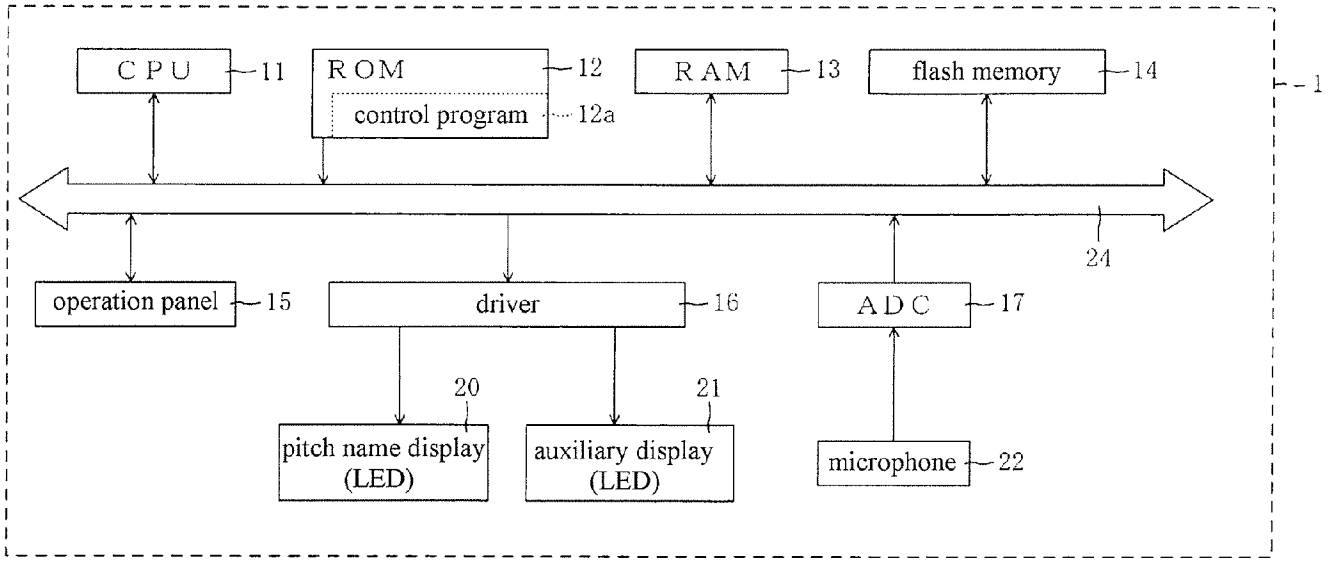
FIG. 5A is a block diagram illustrating an electrical structure of the tuning device.

FIG. 5A is a block diagram illustrating an electrical structure of the tuning device 1. The tuning device 1 includes a CPU 11, a ROM 12, a RAM 13, a flash memory 14, the operation panel 15, a driver 16, an analog-to-digital converter (ADC) 17, the pitch name display 20, the auxiliary display 21, and the microphone 22. The components 11-17 are connected with each other via a bus line 24. The microphone 22 is connected to the ADC 17. The pitch name display 20 and the auxiliary display 21 are connected to the driver 16.

Figure 6:
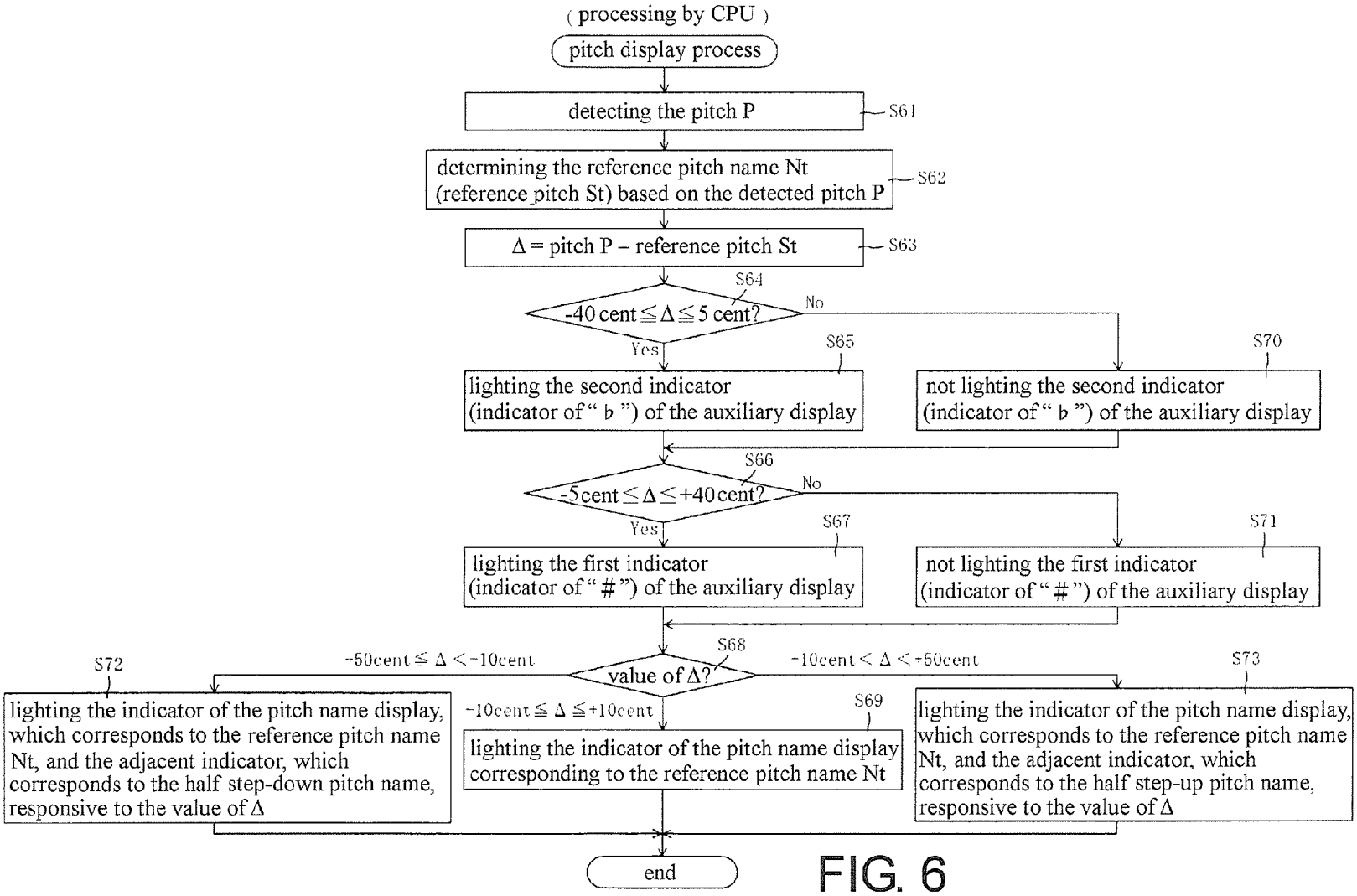
FIG. 6 is a flowchart illustrating the processing of pitch display.
Figure 7:
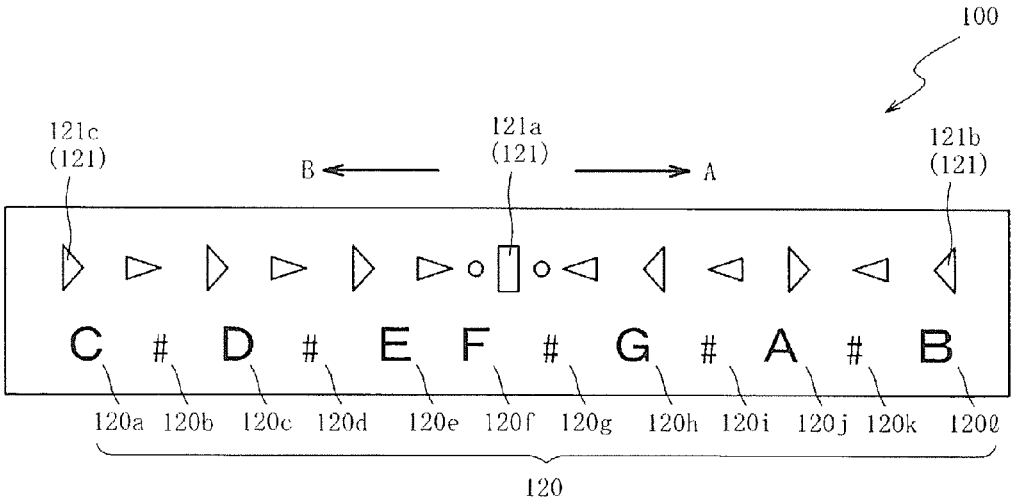
FIG. 7 A (RELATED ART)
FIG. 7A and FIG. 7B are schematic diagrams illustrating the conventional tuning device.
Figure 7:
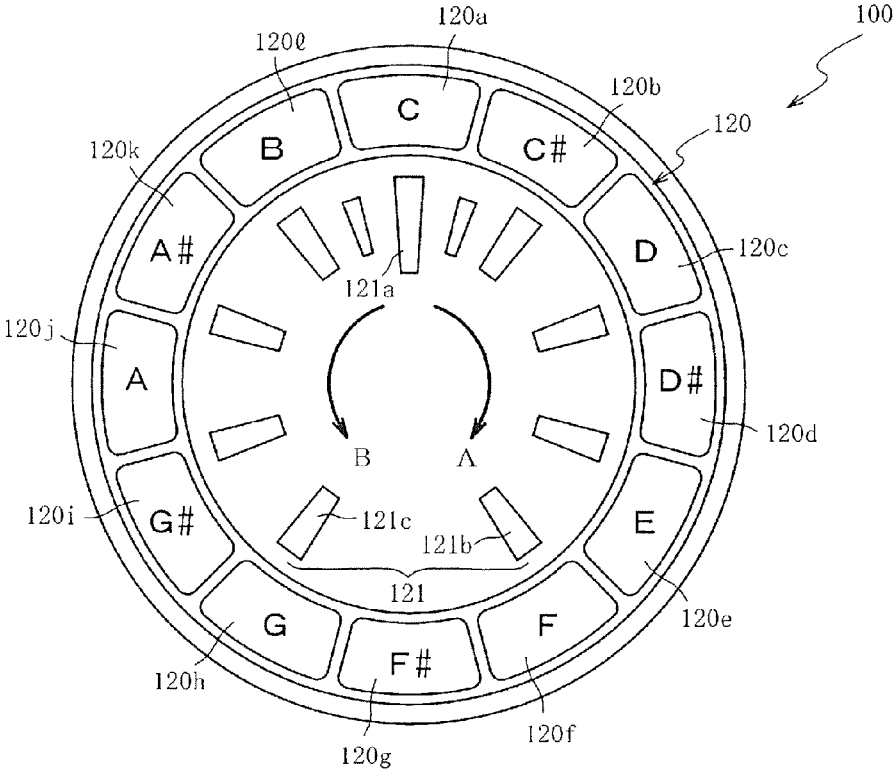
FIG. 7 B (RELATED ART)

The CPU 11 is a central control device that controls each component of the tuning device 1 according to fixed values and programs stored in the ROM 12 and data stored in the RAM 13. The CPU 11 includes a timer (not shown in the figure) therein for measuring time by counting a clock signal. The ROM 12 is an unrewritable non-volatile memory that stores a control program 12*a* executed by the CPU 11 and a fixed value data (not shown in the figure) referred by the CPU 11 when the control program 12*a* is executed, etc. In addition, the steps in the flowchart of FIG. 6 are executed on the basis of the control program 12*a*.

The RAM 13 is a rewritable volatile memory that has a temporary area for temporarily storing various data upon the execution of the control program 12*a* performed by the CPU 11. The flash memory 14 is a rewritable non-volatile memory which stores pitch data of various pitches that are to be displayed by the pitch name display 20 as the target pitches. The operation panel 15 is a panel provided with an operator for the user to input various instructions and indicators composed of 7-segment LEDs.

The driver 16 is an LED driver that is connected to the LEDs respectively provided to the indicators 20*a*-20*l* of the pitch name display 20 and the LEDs respectively provided to the indicators 21*a* and 21*b* of the auxiliary display 21 to light the LEDs. The driver 16 lights the LED of the indicated target in accordance with the control information, which indicates the lighting foam, inputted from the CPU 11. The driver 16 controls the luminance of each LED by pulse width modulation (PWM) control. Therefore, in the case that the control information provided from the CPU 11 indicates the luminance of the LED, a power pulse with a duty ratio corresponding to the indicated luminance is supplied to the control target, i.e. the LED. Accordingly, the LEDs respectively provided to the indicators 20*a*-20*l* and the indicators 21*a* and 21*b* are lighted at the luminance corresponding to the duty ratio of the supplied power pulse, namely, the luminance indicated by the CPU 11.

Figure 5B:
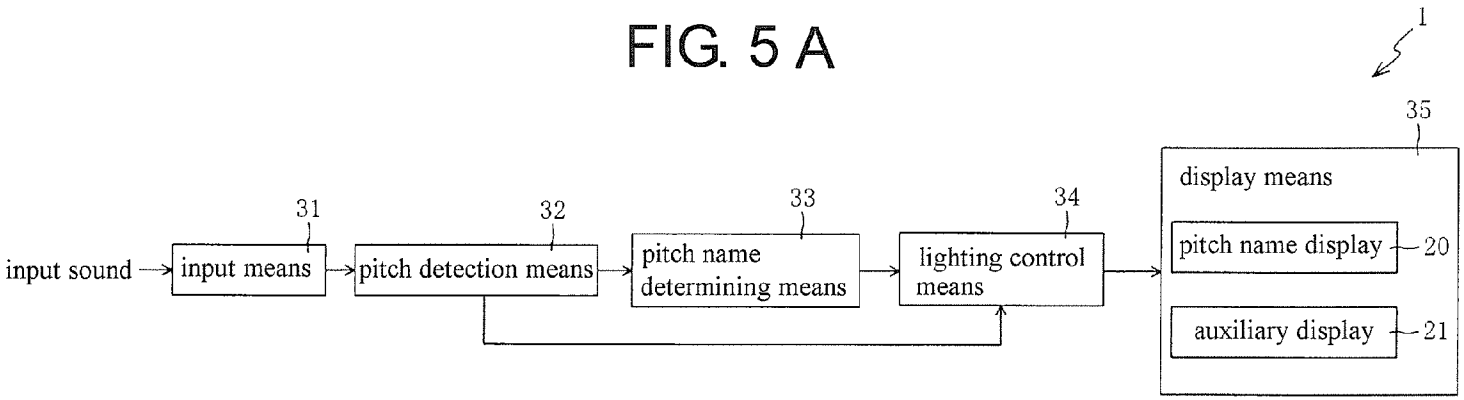
FIG. 5B is a functional block diagram illustrating functions of the tuning device 1.

FIG. 5B is a functional block diagram illustrating functions of the tuning device 1. As illustrated in FIG. 5B, the tuning device 1 includes an input means 31, a pitch detection means 32, a pitch name determining means 33, a lighting control means 34, and a display means 35. The input means 31 has a function of inputting the sound to be tuned (i.e. the input sound), which is the target of tuning, e.g. vocal sound and instrument sound, etc., into the tuning device 1, and is implemented by the microphone 22 and the ADC 17. The input means 31 supplies the input sound to the pitch detection means 32.

The pitch detection means 32 has a function of detecting the pitch of the input sound supplied from the input means 31 and is implemented by the CPU 11, etc. The pitch detection means 32 supplies the detected pitch of the input sound to the pitch name determining means 33 and the lighting control means 34.

The pitch name determining means 33 has a function of determining the reference pitch name corresponding to the reference pitch that is the target pitch, to which the pitch of the input sound should be matched, during tuning, and is implemented by the CPU 11, etc. The pitch name determining means 33 determines the reference pitch name based on the pitch of the input sound supplied from the pitch detection means 32. More specifically, the pitch name determining means 33 selects the pitch name that has the reference pitch closest to the pitch of the input sound as the reference pitch name. The pitch name determining means 33 supplies the determined reference pitch name to the lighting control means 34.

The lighting control means 34 has a function of controlling the lighting of the pitch name display 20 and the lighting of the auxiliary display 21, and is implemented by the CPU 11 and the driver 16, etc. The lighting control means 34 supplies the power pulse with the duty ratio corresponding to the lighting luminance to the display means 35, based on the pitch of the input sound provided from the pitch detection means 32 and the reference pitch name (reference pitch) provided from the pitch name determining means 33, for the target indicator among the indicators 20*a*-20*l* of the pitch name display 20 and the indicators 21*a* and 21*b* of the auxiliary display 21.

The display means 35 has a lighting function and is implemented by the LEDs respectively provided to the indicators 20*a*-20*l* of the pitch name display 20 and the LEDs respectively provided to the indicators 21*a* and 21*b* of the auxiliary display 21. When the power pulse is supplied from the lighting control means 34, the LED (display means 35), namely, the lighting target, with respect to the lighting control means 34 is lighted.

FIG. 6 is a flowchart illustrating a pitch display process performed by the CPU 11 of the tuning device 1 having the aforementioned structure. The pitch display process is a process for controlling the display performed by the pitch name display 20 and the auxiliary display 21 on the basis of the pitch of the input sound inputted from the microphone 22. The pitch display process is initiated upon the instruction of start of the tuning process and is executed repeatedly at predetermined time intervals thereafter by a predetermined operation with respect to the operation panel 15.

The CPU 11 first detects the pitch P of the input sound (S61) and determines the reference pitch name Nt (the reference pitch St) based on the detected pitch P (S62). To be more specific, in S62, the CPU 11 selects the pitch name with the reference pitch St that is closest to the detected pitch P of the input sound as the reference pitch name Nt. Next, the CPU 11 subtracts the reference pitch St determined in S62 from the pitch P detected in S61, and calculates the difference Δ of the pitch P of the input sound relative to the reference pitch St in a unit of cent (S63).

If the CPU 11 determines that the difference Δ obtained in S63 is in the range of −40 cent or more and +5 cent or less (S64: Yes), the CPU 11 outputs control information to the driver 16 so as to light the LED of the second indicator 21*b* (i.e. indicator of "♭") of the auxiliary display 21 at the luminance of 100% (S65). On the other hand, if the CPU 11 determines that the difference Δ is not in the range of −40 cent or more and +5 cent or less (S64: No), the CPU 11 outputs control information to the driver 16 to make the LED of the second indicator 21*b* light-off (S70). Accordingly, in the case that the difference Δ of the pitch of the input sound relative to the reference pitch St is within the range of −40 cent≤Δ≤+5 cent, the second indicator 21*b* is lighted. Outside this range, the second indicator 21*b* is not lighted.

Moreover, if the CPU 11 determines that the difference Δ obtained in S63 is in the range of −5 cent or more and +40 cent or less (S66: Yes), the CPU 11 outputs control information to the driver 16 so as to light the LED of the first indicator 21*a* (i.e. indicator of "♯") of the auxiliary display 21 at the luminance of 100% (S67). On the other hand, if the CPU 11 determines that the difference Δ is not in the range of −5 cent or more and −40 cent or less (S66: No), the CPU 11 outputs control information to the driver 16 to make the LED of the first indicator 21*a* light-off (S71). Accordingly, in the case that the difference Δ of the pitch of the input sound relative to the reference pitch St is within the range of −5 cent≤Δ≤+40 cent, the first indicator 21*a* is lighted. Outside this range, the first indicator 21*a* is not lighted.

Thereafter, if the CPU 11 determines that the difference Δ obtained in S63 is in the range of −10 cent≤Δ≤+10 cent (S68: −10 cent<Δ<+10 cent), the CPU 11 outputs control information to the driver 16 so as to light the indicator of the pitch name display 20, which corresponds to the reference pitch name Nt, at the luminance of 100% (S69), and ends the process. Accordingly, in the case that the difference Δ of the pitch of the input sound relative to the reference pitch St is within the range of −10 cent≤Δ≤+10 cent, the indicator corresponding to the reference pitch name Nt is lighted at the luminance of 100%.

Meanwhile, in the case that the CPU 11 determines that the difference Δ obtained in S63 is in the range of −50 cent≤Δ<−10 cent (S68: −50 cent≤Δ<−10 cent), the CPU 11 outputs control information to the driver 16 so as to light the indicator of the pitch name display 20, which corresponds to the reference pitch name Nt, and the indicator, which is adjacent to the aforesaid indicator and corresponds to the half step-down pitch, at the luminance corresponding to the difference Δ (S72), and ends the process. In S72, for example, the luminances of the two indicators are determined in accordance with the relationship illustrated by the graph of FIG. 3. Accordingly, in the case that the difference Δ of the pitch of the input sound relative to the reference pitch St is in the range of −50 cent≤Δ<−10 cent, the luminance of the indicator corresponding to the reference pitch name Nt gradually decreases as the absolute value of the difference Δ increases, and the luminance of the indicator that is adjacent to the aforesaid indicator and corresponds to the half step-down pitch increases as the absolute value of the difference Δ increases.

In addition, in the case that the CPU 11 determines that the difference Δ obtained in S63 is in the range of +10 cent<Δ<+50 cent (S68: +10 cent<Δ<+50 cent), the CPU 11 outputs control information to the driver 16 so as to light the indicator of the pitch name display 20, which corresponds to the reference pitch name Nt, and the indicator, which is adjacent to the aforesaid indicator and corresponds to the half step-up pitch, at the luminance corresponding to the difference Δ (S73), and ends the process. In S73, for example, the luminances of the two indicators are determined in accordance with the relationship illustrated by the graph of FIG. 3. Accordingly, in the case that the difference Δ of the pitch of the input sound relative to the reference pitch St is within the range of +10 cent<Δ<+50 cent, the luminance of the indicator corresponding to the reference pitch name Nt gradually decreases as the absolute value of the difference Δ increases, and the luminance of the indicator that is adjacent to the aforesaid indicator and corresponds to the half step-up pitch increases as the absolute value of the difference Δ increases.

As described above, for the tuning device 1 of this exemplary embodiment, when the difference of the pitch of the input sound relative to the reference pitch is small and within the range that can be determined as matching the reference pitch, only one of the twelve indicators 20*a*-20*l* of the pitch name display 20, which corresponds to the reference pitch, is lighted at the maximum luminance of 100% (i.e. in-tune state), and the two indicators adjacent thereto are not lighted. On the other hand, if the difference of the pitch of the input sound relative to the reference pitch increases to a certain degree, the indicator, which corresponds to the reference pitch, and the indicator, which corresponds to the pitch name adjacent to the reference pitch name and close to the pitch of the input sound, are both lighted. And, as the absolute value of the difference between the reference pitch and the pitch of the input sound increases (that is, as the pitch of the input sound deviates away from the reference pitch), the luminance of the indicator corresponding to the reference pitch name gradually decreases, and at the same time, the luminance of the adjacent indicator gradually increases. Accordingly, the reference pitch name that corresponds to the pitch of the input sound and the degree of pitch deviation of the input sound (i.e. the target sound to be tuned) relative to the reference pitch can be checked intuitively by looking at the luminance degree of two adjacent indicators on the pitch name display 20. Therefore, in comparison with the conventional tuning process that requires alternately watching two displays (i.e. pitch name display and auxiliary display) at the same time, the tuning device 1 makes it easy to check the reference pitch name and the pitch deviation degree relative to the reference pitch.

Moreover, in the case that the pitch of the input sound varies continuously in one direction, the indicators 20*a*-20*l* of the pitch name display 20 become brighter or darker gradually responsive to the variation of the pitch of the input sound, and while the pitch deviation degree of the input sound relative to the reference pitch is shown visually by the difference in luminance (lighting) degree between the indicator corresponding to the reference pitch and the approached indicator, the lighting is switched between the indicators 20*a*-20*l* in sequence to indicate the direction of the pitch variation. Accordingly, when doing scale practice for vocal performance and wind instrument performance, the display of pitch deviation, which varies with the continuously-changing pitch of the input sound, is continuous and smooth, rather than discontinuous or disordered. Thus, in this aspect, the checking of the pitch corresponding to each sound can be easily performed. Particularly, the indicators 20*a*-20*l* of the pitch name display 20 are circularly arranged in the pitch order in a way that one end pitch name and the other end pitch name of the octave adjoin each other. Therefore, no matter which of the twelve pitch names is the reference pitch name corresponding to the initial pitch of the input sound, if the movement of the display position of the indicator corresponding to the pitch of the input sound is toward the direction of higher pitches, the indicators are always lighted in the clockwise direction (C, C♯, D, . . . ), and on the contrary, if the movement of the display position is toward the direction of lower pitches, the indicators are always lighted in the anti-clockwise direction (C, B, A♯, . . . ). That is, the movement of the display position is always in the determined directions. And, there is no unnatural movement, e.g. the display position of the indicator moves in the reverse direction toward the lower pitches while the pitch of the input sound varies in the direction toward higher pitches. In this aspect, the checking of the pitch corresponding to each sound can also be easily performed.

The above illustrates the invention with reference to the exemplary embodiments. However, it should be understood that the invention is not limited to any of these exemplary embodiments, and various modifications or alterations may be made without departing from the spirit of the invention.

For instance, the values given in the exemplary embodiments are merely examples, and other values may also be adopted for the invention.

According to the exemplary embodiments, the indicators 20*a*-20*l* of the pitch name display 20 are arranged circumferentially. Nevertheless, the arrangement of the indicators 20*a*-20*l* is not limited thereto, and the twelve indicators 20*a*-20*l* may be arranged in various circular forms, which put two end pitch names (e.g. pitch names "C" and "B") of a pitch name sequence that includes twelve pitches constituting one octave, adjacent to each other. For example, the twelve indicators 20*a*-20*l* may be arranged in a polygonal form, such as an elliptical, hexangular, or dodecagonal arrangement, etc.

Moreover, the indicators of the pitch name display 20 may also be arranged linearly in the pitch order. In the case that the indicators are linearly arranged, the degree that the pitch of the input sound deviates from the reference pitch closest to the pitch of the input sound within the range of ±100 cent can still be checked based on the luminances of two adjacent indicators. In such a case, for example, thirteen pitch names, i.e. C, C♯, D, D♯, E, F, F♯, G, G♯, A, A♯, B, and C, may be arranged. For such an arrangement, if the pitch name determined based on the pitch of the input sound is located on the right side of the display position of the reference pitch name corresponding to the pitch of a certain input sound and the next pitch name is located on the left side of the display position of the reference pitch name corresponding to the pitch of the next input sound, the lighting is switched over a long distance from the indicator of the pitch name located on the right side to the indicator of the pitch name located on the left side. Considering this, it is preferable to arrange the indicators of the pitch name display 20 circularly, e.g. circumferentially as mentioned in the exemplary embodiments.

In the above exemplary embodiments, among the indicators 20*a*-20*l* of the pitch name display 20, the pitch name notes corresponding to the black keys of a piano are all ♯ notes (C♯, D♯, F♯, G♯, A♯). However, they may be ♭ notes (D♭, E♭, G♭, A♭, B♭) or ♯/♭ notes (e.g. F♯/G♭).

In the exemplary embodiments, the indicators 20*a*-20*l* of the pitch name display 20 are lighted using LEDs as the light source. However, the pitch name display may also be displayed on an LCD and include twelve circumferentially-arranged indicators to respectively serve as the indicators 20*a*-20*l*, and the same as the exemplary embodiments, the indicators may be respectively lighted at the luminance corresponding to the difference between the reference pitch and the pitch of the input sound. For such an arrangement, the display positions of the twelve indicators can be properly changed according to the scale and reference position.

According to the exemplary embodiments, if the difference of the pitch of the input sound relative to the reference pitch is in the range of ±10 cent, the indicator corresponding to the reference pitch name is lighted solely. However, an LED that emits light of multiple colors, e.g. a three-color LED, may be used instead, and when the difference is in a predetermined range (e.g. ±3 cent) which further approximates to 0, the color of the emitted light may be changed or an additional color may be added, so as to change the display form responsive to the state of the tuning. Besides, in the above exemplary embodiments, the difference in octave is not shown when the reference pitch name is the same pitch name. However, the color of the emitted light may be changed to a color that corresponds to the height of the octave in the case that there is a difference in octave, even when the reference pitch name is the same pitch name. Furthermore, another indicator may be separately provided to indicate the difference in octave without changing the color emitted by the pitch name display 20. In such a case, the state of change of the octave can be known and thus pitch information becomes more easily understandable.

In the above exemplary embodiments, a luminance variation of the indicators 20*a*-20*l* responsive to the pitch of the input sound is exemplified by the graph of FIG. 3. However, given that the indicator corresponding to the reference pitch name is lighted at the luminance of 100% when the difference between the reference pitch and the pitch of input sound is small, and the luminance of the indicator corresponding to the reference pitch name decreases while the luminance of the adjacent indicator increases along with the increase of the difference when the difference increases to a certain degree, the luminance variation of the indicators 20*a*-20*l* responsive to the pitch of the input sound may be presented in various forms. The graph of FIG. 3 illustrates that the luminance decreasing rate (or luminance increasing rate) of the indicator corresponding to each adjacent pitch name is varied at the boundary between two adjacent pitch names. However, another luminance variation may be adopted instead. For example, the luminance of the indicator corresponding to one of two adjacent pitch names may decrease from 100% to 0% at the same luminance decreasing rate while the luminance of the indicator corresponding to the other pitch name may increase from 0% to 100% at the same luminance increasing rate. Moreover, the form of decreasing or increasing of the luminance responsive to the pitch variation of the input sound is not necessarily a straight line as shown in the graph of FIG. 3 and may also be a curve.

Further, according to the graph of FIG. 3, the luminances of the indicators respectively corresponding to two adjacent pitch names are equal in the middle between the pitches corresponding to the adjacent pitch names, but the luminances may also differ from each other. However, the luminances in the middle between pitches corresponding to adjacent pitch names are preferably equal, so as to reduce the possibility of misidentifying the pitch name that the pitch of the input sound is close to.

In the above exemplary embodiments, a condition for lighting the indicator corresponding to the reference pitch name at the luminance of 100% is that the difference Δ of the pitch of the input sound relative to the reference pitch is in a range of ±a cent. In addition, in the middle between pitches corresponding to two adjacent pitch names, the luminance of each indicator corresponding to each of the adjacent pitch names is set to a predetermined luminance b %. Moreover, a condition for lighting both of the first indicator 21*a* and the second indicator 21*b* is that the difference Δ of the pitch of the input sound relative to the reference pitch is in a range of ±c cent. And, a condition for not lighting the first indicator 21*a* and the second indicator 21*b* is that the difference Δ of the pitch of the input sound relative to the reference pitch is in a range of +d cent<Δ≤+50 cent or −50 cent≤Δ<−d cent. More specifically, it is exemplified in the above exemplary embodiments that the set values a, b, c, and d are 10, 80, 5, and 40 respectively. However, the set values a, b, c, and d may be determined according to the types of the instruments (e.g. vocal, wind instrument, stringed instrument, etc.) for producing the sound that is to be tuned, or may be properly varied according to the user's proficiency level of vocal performance and instruments. If the user specifies the type of instrument used, the optimal values of a, b, c, and d may be preset by various known methods, such as switching by means of the operator or reference to a table, etc. In addition, a table may be prepared to record several sets of values a, b, c, and d corresponding to different instruments to be switched by operation of the operator, etc., for use with different instruments.

According to the above exemplary embodiments, in the pitch display process of FIG. 6, if the difference Δ of the pitch of the input sound relative to the reference pitch is in the range of −40 cent≤Δ≤+40 cent, the first indicator 21*a* and/or the second indicator 21*b* are lighted. However, a condition may be set to light the first indicator 21*a* and/or the second indicator 21*b* when the difference Δ of the pitch of the input sound relative to the reference pitch remains in the range of −40 cent≤Δ>+40 cent over predetermined time (e.g. 500 msec or more). In such a case, the first indicator 21*a* or the second indicator 21*b* is not lighted instantly when the pitch of the input sound falls within this range (e.g. around 10 msec), and the auxiliary display 21 can be prevented from flickering.

In the above exemplary embodiments, the first indicator 21*a* and the second indicator 21*b* of the auxiliary display 21 are simultaneously lighted to notify that the pitch of the input sound matches the reference pitch in the second in-tune state. However, in addition to the first indicator 21*a* and the second indicator 21*b*, a third indicator may be further provided and configured to be lighted to notify the user of the second in-tune state. Moreover, words, such as "IN-TUNE," may be displayed on an LCD to notify the user of the second in-tune state. Furthermore, a beep sound, such as "beep beep," may be outputted right after the pitch enters the second in-tune state to notify the user of the in-tune state.

It is exemplified in the above exemplary embodiments that the indicators 20*a*-20*l* of the pitch name display 20 are respectively lighted responsive to the pitch of the sound inputted from the microphone 22. However, in addition to lighting the indicators 20*a*-20*l* responsive to the pitch of the input sound, the indicators 20*a*-20*l* may also be lighted responsive to the pitch of a target sound which is set as the target of tuning by the user. The target sound may be designated by means of an exclusive operator, or by providing the twelve indicators 20*a*-20*l* a target sound setting function (self-illuminated switch, etc.) and operating the indicator corresponding to the desired pitch name as the target sound. Moreover, the target sound may be designated on the basis of a MIDI sequence data, etc., from an external machine connected to the tuning device 1. In that case, by matching the melody of singing and the scale of wind instrument practice, for example, to the playback of music at a moderate tempo for practice and inputting the same as the target sound, singing practice and scale practice can be performed in accordance with the playback of accompaniment data at the desired tempo in order to achieve stable pitch of each sound from the start of the pitch. In the case that the indicators 20*a*-20*l* are lighted responsive to the pitch of the target sound, the CPU 11 acquires pitch data of the pitch name (pitch) designated as the target sound by the user from the flash memory 14 and lights the indicator corresponding to the pitch name which corresponds to the acquired pitch data. In such a case, the lighting control means 34 corresponds to the third lighting control means.

Further, in the case of lighting the indicator corresponding to the pitch name of the target sound, the lighting form of the indicator corresponding to the pitch name of the target sound is preferably different from the lighting form of the indicator corresponding to the pitch of the input sound. By differentiating the display forms of the aforesaid indicators, the user can clearly distinguish the indicator corresponding to the pitch name of the target sound from the indicator that is lighted responsive to the pitch of the input sound, which allows the user to carry out the tuning for the target sound easily. The lighting forms of the indicator corresponding to the pitch name of the target sound and the indicator corresponding to the pitch of the input sound may for example be distinguished by different colors of emitted light, different luminances, and different light-on/light-off foil is, such as differences in lighting time and lighting interval, etc.

In the above exemplary embodiments, the detected pitch is used directly without any change. However, a conventional method may be employed to average the detected pitch so as to reduce pitch swing of the pitch indicators. For vocal performance, even when the performer sings at a certain pitch, the display of the pitch name display 20 may still swing due to the pitch range of vibrato swing. By averaging the pitch, such display swing can be suppressed.

According to the above exemplary embodiments, each of the indicators of the pitch name display 20 is a semitone unit (namely, the pitch of one octave is divided into twelve units). However, the pitch may be further divided into a ½ semitone unit per indicator (namely, the pitch of one octave is divided into 24 units) or even smaller unit.

In the above exemplary embodiments, the brightness of the indicators 20*a*-20*l* of the pitch name display 20 is presented by the unit of "luminance." However, the brightness may also be presented by units, such as "illumination" and "luminosity," etc. Moreover, in the above exemplary embodiments, the luminance of 100% is exemplified as the maximum luminance; however, a luminance other than 100% may also be set as the relatively maximum luminance.

What is claimed is:

1. A tuning device, comprising:

a pitch name display means comprising a plurality of display positions that are arranged in a pitch order respectively corresponding to a plurality of pitch names constituting an octave;

a pitch detection means detecting a pitch of an input sound;

a pitch name determining means determining one of the plurality of pitch names constituting the octave as a reference pitch name based on the pitch of the input sound detected by the pitch detection means, wherein the reference pitch name has a reference pitch closest to the pitch of the input sound;

a first lighting control means lighting a reference display position, being the display position corresponding to the reference pitch name, wherein when a difference between the reference pitch corresponding to the reference pitch name determined by the pitch name determining means and the pitch of the input sound is in a range of $\pm\alpha$, wherein $\alpha>0$, lighting both the reference display position and an adjacent display position, which is the display position adjacent to the reference display position and corresponds to the pitch name that is close to the pitch of the input sound, in a way that a luminance of the reference display position gradually decreases and a luminance of the adjacent display position gradually increases as an absolute value of the difference increases when the difference is outside the range.

2. The tuning device according to claim 1, wherein the plurality of display positions of the pitch name display means are circularly arranged in the pitch order in a way that the pitch name at one end and the pitch name at the other end of the octave adjoin each other.

3. The tuning device according to claim 2, wherein the first lighting control means lights the reference display position at the maximum luminance when the difference is in a first range of $\pm\alpha$, wherein $\alpha>0$.

4. The tuning device according to claim 2, further comprising a notification control means which visually or audibly notifies that the difference is in a predetermined second range set within the first range of $\pm\alpha$, wherein $\alpha>0$.

5. The tuning device according to claim 2, further comprising:

an auxiliary display means comprising a first display position indicating that the pitch of the input sound deviates to a high pitch side relative to the reference pitch name, and a second display position indicating that the pitch of the input sound deviates to a low pitch side relative to the reference pitch name; and a second lighting control means controlling lighting of the first display position and the second display position responsive to the difference.

6. The tuning device according to claim 5, wherein the second lighting control means does not light the first display position and the second display position when the difference is outside a range of $\pm\beta$, wherein $\beta>\alpha$, and in a range of {(the reference pitch of the pitch name adjacent to the reference pitch name−the reference pitch of the reference pitch name)/2}, wherein this value$\neq\pm\beta$.

7. The tuning device according to claim 5, wherein the second lighting control means controls the lighting of the first display position and/or the second display position responsive to the difference when the difference is in the range of $\pm\beta$, wherein $\beta>\alpha$, over predetermined time.

8. The tuning device according to claim 2, wherein the first lighting control means lights the reference display position and the adjacent display position at equal luminance when the difference is {(the reference pitch of the pitch name adjacent to the reference pitch name−the reference pitch of the reference pitch name)/2}.

9. The tuning device according to claim 2, further comprising a third lighting control means lighting a tuning target display position, which is the display position corresponding to the pitch name that is to be tuned, in a lighting form different from a lighting form in which the reference display position or the adjacent display position is lighted by the first lighting control means.

* * * * *